United States Patent [19]

Wright, Jr.

[11] Patent Number: 4,648,564

[45] Date of Patent: Mar. 10, 1987

[54] QUICK RELEASE YARN PACKAGE HOLDER

[76] Inventor: Joe Wright, Jr., P.O. Box 6763, Greenville, S.C. 29606

[21] Appl. No.: 734,552

[22] Filed: May 16, 1985

[51] Int. Cl.[4] ..... B65H 49/10; D03J 5/16; F16D 1/00

[52] U.S. Cl. ..... 242/130; 242/131; 403/70; 403/350

[58] Field of Search ..... 242/129.7, 130, 130.1, 242/130.2, 131, 131.1, 141; 211/6, 44, 13, 54.1, 57.1; 248/65, 73, 316.1, DIG. 7; 24/457, 458; 403/70, 71, 342, 350, 374

[56] References Cited

U.S. PATENT DOCUMENTS

| | | | |
|---|---|---|---|
| 3,942,826 | 3/1976 | Lester | 403/350 |
| 4,368,859 | 1/1983 | Focke et al. | 242/130 |
| 4,399,957 | 8/1983 | Singer | 242/130 |
| 4,556,178 | 12/1985 | Singer | 242/130 |

*Primary Examiner*—Stuart S. Levy
*Assistant Examiner*—David Werner
*Attorney, Agent, or Firm*—Cort Flint

[57] ABSTRACT

A yarn package holder device (10) is disclosed which includes a bracket plate (12) adapted to be mounted to a supporting structure (14). A circular cam (A) is rotatably journaled in the bracket plate and is eccentrically connected to a shaft (24) having a remote end affixed to an actuator lever (30) and handle (32). The actuator lever rotates the cam (A) and moves a cam surface (22) in an eccentric path. On the eccentric path, the cam surface (22) includes a lock position with the actuator lever (30) in a down set position. Lifting the actuator lever from the down set position quickly releases the cam lock provided between the cam surface (22) and a ribbed clamping surface (34) permitting rapid removal of an empty tube (38) from which a yarn package (40) has been withdrawn.

20 Claims, 5 Drawing Figures

QUICK RELEASE YARN PACKAGE HOLDER

The invention relates to a yarn package holder device for firmly clamping and holding a yarn package of the type which typically includes yarn wound upon a conical or cylindrical tube.

If yarn is to be withdrawn at high speeds from a yarn package wound upon a conical or cylindrical tube, a firm mounting of the tube on a creel or other support structure is necessary. The tube should be mounted in such a way that it can be mounted and removed quickly and in a manner which assures uniform orientation of the yarn package. The axis of the cylinder or conical tube must coincide with the eyelet through which the yarn is withdrawn for feeding to a shuttleless loom and the like. Due to the large weight and diameter of the yarn package, the quick mounting of the yarn package in a highly reliable manner which assures proper orientation is a problem to which considerable attention need be given.

Yarn package holder devices have been proposed in U.S. Pat. No. 3,850,394 in which a pair of spreading levers extend through the entire core of the tube and spread to lock the tube on the device. However, the problem occurs that such a device is relatively complicated and includes a large number of moving parts rendering it relatively expensive and susceptible to unreliability.

U.S. Pat. No. 4,399,957 discloses a relatively simplified yarn package holder which includes a fixed wedging member and a pivotal spring-loaded wedging machine between which a tube is wedged. However, it has been found that due to vibrations the yarn package tends to wobble away from the bracket plate. This is because the pivoting wedging lever can only operate under a biasing force and not a true locking force.

Accordingly, an important object of the present invention is to provide a yarn package holder device which positively locks a yarn package.

Another important object of the present invention is to provide a yarn package holding device which is simple in construction, yet is reliable and positively locks a tube of a yarn package, and may be quickly released when depleted.

SUMMARY OF THE INVENTION

The above objectives are accomplished according to the present invention by providing a bracket plate which is adapted for mounting to a support structure. A radius camming block having a ribbed clamping surface is carried on the mounting bracket and a cam is carried below the clamping surface. A shaft rotatably journaled in the bracket plate is affixed to the cam at an eccentric location. An actuator lever is affixed to the opposing end of the shaft. A widened cam surface formed on the cam moves between a lock position and a release position as it travels in an eccentric path. In the lock position, the actuator lever is in a down set position and the tube of the yarn package is positively locked between the cam surface and the clamping surface. To release the yarn package, the actuator lever is quickly lifted from its set position whereby the yarn package is quickly released.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
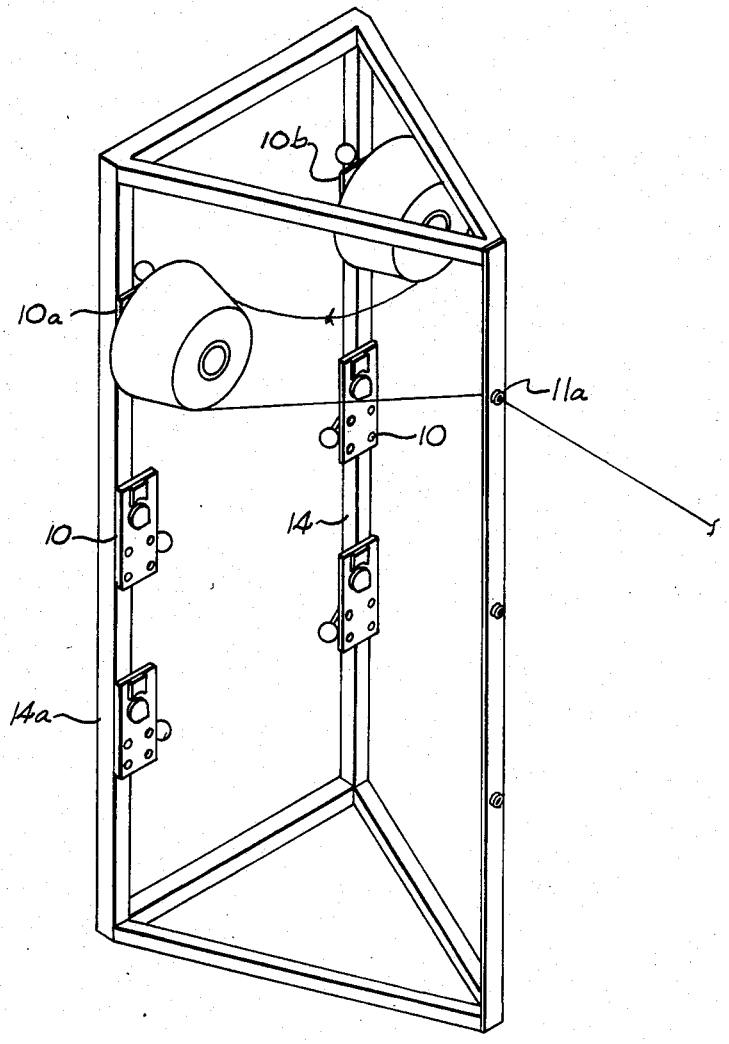
FIG. 1 is a perspective view illustrating a yarn package holding device constructed according to the invention mounted on a creel.

The invention relates to a quick release yarn package holder device 10 for holding a yarn package on a creel 11. The holder devices are arranged in pairs wherein each pair, 10*a* and 10*b* for example, hold a pair of yarn packages tailed together. Upon depletion, the empty tube is thrown away and replaced with a full yarn package, the leading end of which is tied to the tail of the packaged being employed. Yarn is withdrawn through eyelets 11*a* carried in the front of the creel. A number of yarn package holding devices may be carried on the creel, vertically or horizontally arranged.

Referring now in more detail to the drawings, a yarn package holding device is illustrated at 10 as including a bracket plate 12 adapted to be mounted to a supporting leg 14 of the creel 11. Threaded fasteners 16 and conventional nuts may be used to mount the back of the plate to the support structure. Four openings 20 may be provided for the threaded fasteners.

There is a cam means rotatably carried by the bracket plate 12. The cam means includes a circular cam A having a grooved or ribbed camming surface 22 which consists generally of a wide, flat circular band having grooves 22*a* around the circumference of the cam defining ribs 22*b*.

Means for actuating the cam include a shaft 24 rotatably carried by the plate 12 having one end eccentrically connected to the cam at 26. Affixed to the opposing end of the shaft 24 is a collar 28 having an actuator lever 30 affixed thereto. A handle 32 for the lever may be threaded onto the end for actuation. The circular cam A may be rotated by the lever 30 in an eccentric path.

Figure 3:
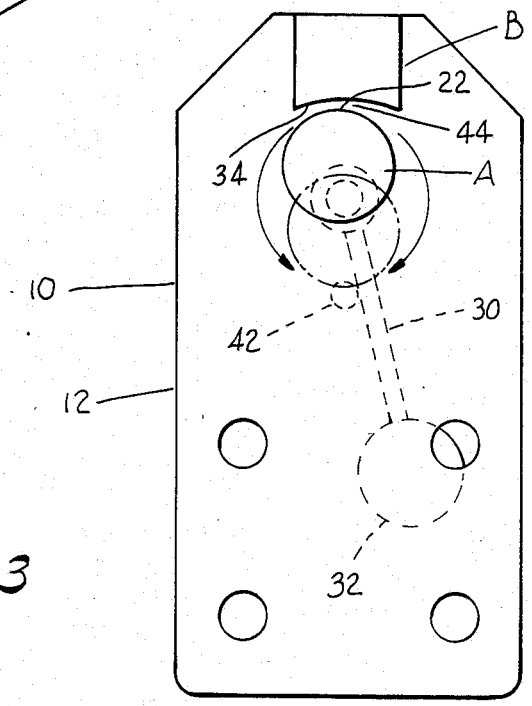
FIG. 3 is a front elevation illustrating a yarn package holding device constructed according to the present invention having a cam surface which moves in an eccentric path between a lock position and a release position.
Figure 4:
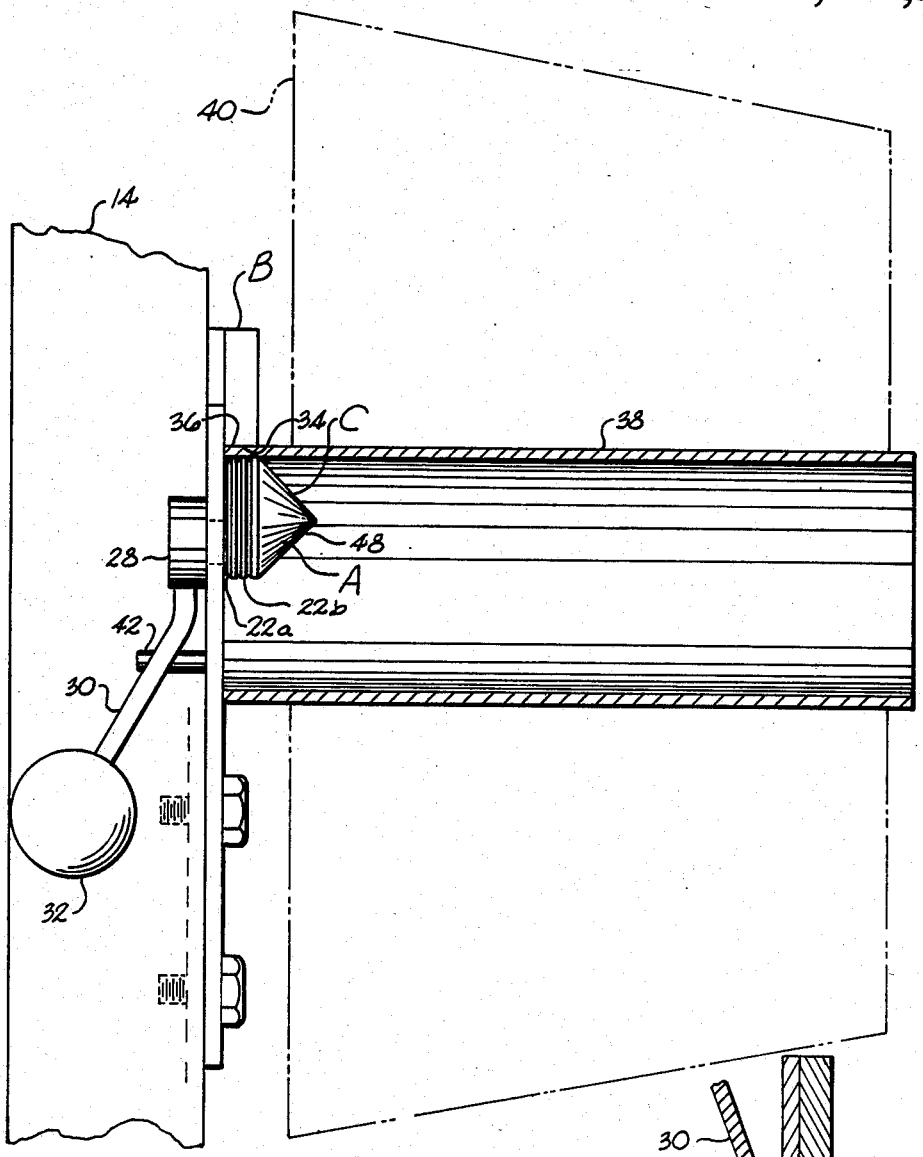
FIG. 4 is a side elevation illustrating a yarn package holding device constructed in accordance with the present invention for positively holding a yarn package.

A clamping means is provided by a radius camming block B having a radius clamping surface 34 against which an edge portion 36 of a tube 38 is tightly clamped, as best can be seen in FIG. 3. In FIG. 3, the tube 38 is illustrated as a cylindrical tube, it being understood, of course, that a conical tube may be also utilized with the present invention. A package of yarn 40 is illustrated schematically wound upon tube 38. The tube 38 is firmly clamped and locked between the clamping surface 34 and the cam surface 22 of the circular cam A. The radius camming block has a surface radius which conforms generally to the tube curvature. The camming surface also has a radius which is complimentary to the clamping of the tube against the radius camming block. The yarn package 40 is firmly held on the support structure 14 for withdrawal of yarn by an associated machine (not shown).

Figure 2:
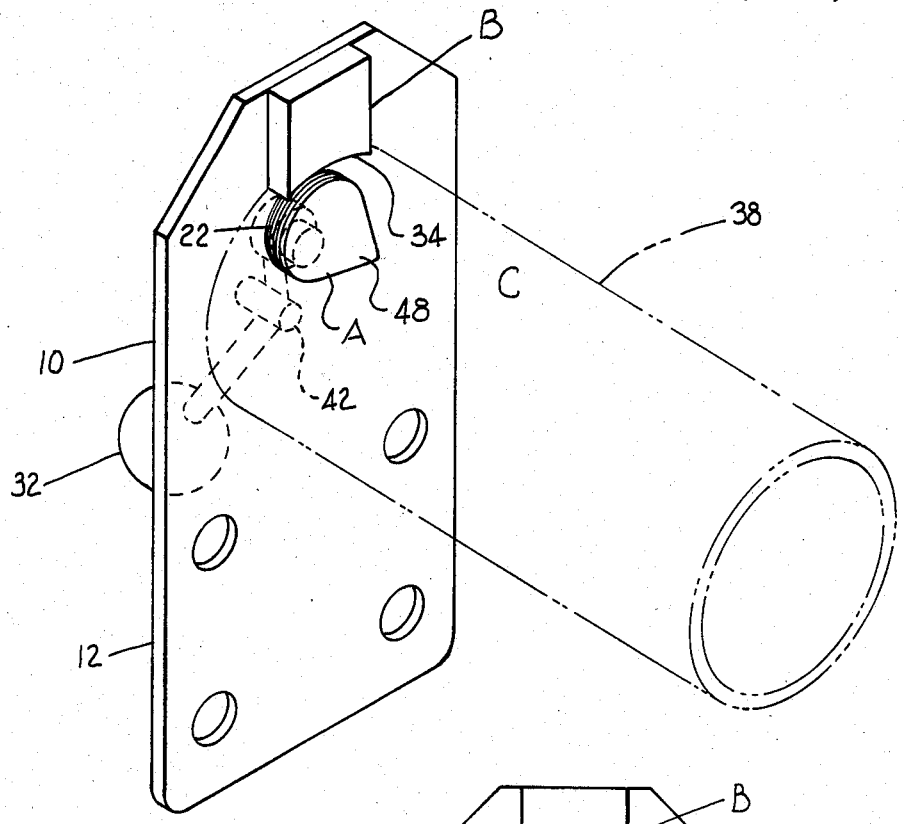
FIG. 2 is a perspective view illustrating a yarn package holding device constructed according to the present invention.
Figure 5:
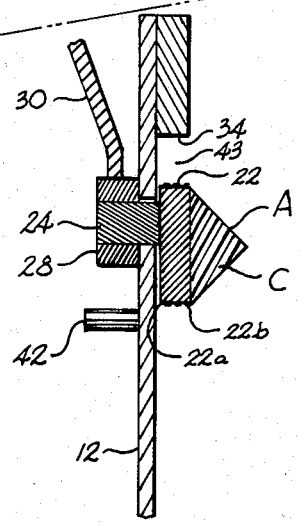
FIG. 5 is a sectional view illustrating the device of FIG. 4 in a release position.

As can best be seen in FIG. 3, the actuator lever 30 moves the cam A and the cam surface 22 in an eccentric path between a lock and release position. With the actuator lever 30 in a downward position against a stop 42 as can be best seen in FIGS. 2 and 3, the camming surface 22 is in the lock position in which the tube is firmly locked and held on the bracket plate 12. The lever is in a lock position when abutting the stop on either the left or right side. If the actuator lever 30 is lifted toward an upright position, as seen in FIG. 5, the cam lock is quickly released so that the empty tube can be replaced and a new full yarn package mounted quickly. In the upright release position, there is a widened gap 43 between the clamping surface 34 and the cam surface 22 for placement of an edge of a new tube and a full yarn package. After placement of the full yarn package on the bracket plate, the actuator handle 32 may again be brought down to the set lock position and the tube firmly locked onto the bracket. As can best be seen in FIG. 3, there is a predetermined clamping gap 44 between the cam surface and clamping surface when the lever is in the lock position wherein the surfaces are closest together.

To facilitate placement of the tube upon the flat cam surface 22 for positive locking, there is provided a guide means C on the cam A. It is often difficult for the attendant to see the surface area of the plate 12 surrounding the cam A when placing a large yarn package on the bracket plate. Yarn package up to 16 inches in diameter are often utilized. For this purpose, the guide means includes a tapered surface 48 which tapers from the cam surface 22 downwardly to a point. The tapered surface is in the form of a conical end surface. As the edge portion 36 of the tube 30 engages the conical surface 48, the tube will ride up and onto the cam surface 22 automatically with the back of the tube flush against the back of the plate. The actuator lever 30 is lowered to its lock position. The tube and full yarn package are locked onto the attachment bracket. The ribs **22*b*** will bite into the tube wall locking the tube in the clamped position. It has been found that this expedient helps to prevent the yarn package from "walking off" as has occurred with prior yarn package holders.

With the attachment bracket mounted to a supporting creel or other supporting structure, the yarn is fed through the central eye **11*a*. It is to be understood that several of the mounting brackets will be normally utilized on the supporting creels 11**.

It can thus be seen that a highly advantageous construction can be had for a yarn package holding device according to the invention wherein a large yarn package may be firmly held on a supporting structure for withdrawal of the yarn and feeding to the loom. The clamp lock may be quickly released by lifting-up the actuating lever to the left or right of the lock position to quickly remove the empty tube for rapid yarn replenishment by the attendant. Due to the wedging nature of the wall of the tube at 36 between the ribbed camming surface 22 and the clamping surface 34, the lock is firmly held in the lock position and the tube is firmly held on the bracket device. The cam surface 22 is made sufficiently wide so that the length of the tube at the edge portion 3 is supported and wedged against the clamping surface. The clamping surface coextends with the cam surface. If the bracket is mounted on leg **14*a* of the creel, lever 30 abuts set stop 42** on the left side (facing). Thus, the holder device and bracket may be interchangeably used.

While a preferred embodiment of the invention has been described using specific terms, such description is for illustrative purposes only, and it is to be understood that changes and variations may be made without departing from the spirit or scope of the following claims.

What is claimed is:

1. A yarn package holder device for securely holding a yarn package wound upon a tube comprising:

a bracket plate adapted to be mounted to an associated support structure;

a clamping surface carried adjacent one end of said bracket;

an eccentrically mounted cam rotatably carried on said bracket plate;

actuator means for rotating said cam on said bracket plate; and a cam surface carried by said cam movable on an eccentric path from a lower release position to an upper most lock position in which said cam surface firmly clamps said tube of said yarn package between said cam surface and said clamping surface whereby said yarn package is firmly held by said bracket plate.

2. The device of claim 1 including guide means for positively guiding said tube upon said cam surface as said tube is moved towards said cam from a front loading position.

3. The device of claim 1 wherein said cam includes a forwardly projecting tapered guide surface for positively guiding said edge of said tube upon said cam surface as said yarn package is loaded from the front of said bracket plate.

4. The device of claim 1 wherein said cam includes a forwardly projecting conical surface tapering away from said cam surface for guiding said edge of said tube positively upon said cam surface for clamping between said clamping surface and cam surface.

5. The device of claim 1 wherein said actuator means include a shaft eccentrically connected to said cam rotatably carried by said bracket; and a lever connected to said shaft for manually rotating said cam and moving said cam surface in an eccentric path.

6. The device of claim 1 wherein said cam is of a circular configuration and said cam surface includes a planar band formed around the outer circumference of said circular cam having a sufficient width in order to firmly engage a length of said edge of said tube for positively forcing said tube into clamping engagement with said clamping surface.

7. The device of claim 6 wherein said actuator means includes:

a shaft eccentrically connected to said circular cam rotatably carried by said bracket plate;

an actuator lever affixed to said shaft for rotating said circular cam;

said lever being connected to said shaft so that said lever is in lowered position when said cam surface is in said lock position; and said actuator lever extending sufficiently away from said bracket plate to enable an attendant to manually raise said actuator lever to said upright position to quickly release said tube from said lock position.

8. The device of claim 1 wherein said camming surface includes a number of circumferential grooves formed in said surface defining clamping ribs.

9. The device of claim 1 wherein said clamping surface is formed on an end of a radius camming block having a curvature complimentary to said tube whereby said tube is positively clamped.

10. The device of claim 1 including a stop for engaging said actuator means and positively resetting said cam surface in said lock position.

11. A yarn package holder device for securely holding a yarn package wound upon a tube comprising:

a bracket plate adapted to be mounted to a supporting structure;

cam means rotatably carried by said bracket plate;

a cam surface formed on said cam means;

a clamping surface carried by said bracket plate in a juxtaposed position relative to said cam surface;

guide means carried by said cam means for positively guiding said edge of said tube upon said cam surface for clamping between said cam surface and said clamping surface; and actuator means for rotating said cam to move said cam surface in a eccentric path from an uppermost lock position in which said edge of said tube is firmly clamped between said cam surface and said clamping surface to a lower release position wherein said yarn package may be mounted to said device and removed therefrom.

12. The device of claim 11 wherein said actuator means includes:

a shaft rotatably carried by said bracket plate; and an actuator lever affixed to said shaft extending away from said bracket plate a sufficient distance to enable the actuator lever to be engaged manually by a side knock-off motion by an attendant.

13. The device of claim 11 comprising:

said cam surface including a generally flat band extending around a outer periphery of said cam means having a sufficient width to support said tube for clamping against said clamping lip; and said guide means including a tapered surface tapering outwardly and downwardly from said cam surface whereby said tube is guided upwardly and onto said cam surface when moved towards said bracket plate from a front loading position.

14. The device of claim 11 comprising:

a shaft eccentrically connected to said cam means;

an actuator lever connected to said shaft extending outwardly and above said bracket plate when said cam surface is in said lock position;

a set stop carried by said bracket plate for abutting and setting the position of said actuator lever;

said actuator lever extending away from said bracket plate in a generally downward configuration against said set stop so that said actuator lever may be knocked-off and lifted to quickly unlock and release said tube from said bracket plate.

15. A yarn package holder device for securely holding a yarn package wound upon a tube comprising:

a bracket plate adapted to be mounted to a supporting structure;

a cam having an eccentric cam surface with a number of circumferential clamping ribs formed on said cam surface;

a radius camming block carried by said bracket plate generally above said cam;

an actuator means affixed to said cam for manual operation of said cam;

said actuator means being movable to a lock position where said cam surface positively clamps an edge of said tube against said radius camming block and a release position wherein said cam surface is moved away from said camming block to permit mounting or release of said yarn package from said device.

16. The device of the claim 15 wherein said cam includes a contoured guide surface for positively guiding said edge of said tube upon said cam surface as said yarn package is placed on said bracket device from a front loading position.

17. The device of the claim 16 wherein said guiding surface includes a conical surface which tapers down and away from said cam surface.

18. The device of claim 15 including a stop for limiting movement of said actuator means and setting said cam in a preset set position wherein a predetermined clamping gap is provided bewteen said cam and radius camming block in said lock position.

19. The device of claim 15 wherein said radius camming block includes an arcuate clamping surface having a radius corresponding generally to said tube.

20. The device of claim 18 wherein said cam is set in said lock position with said actuator means limited in its movement by either side of said stop whereby said actuator means may be operated from a lock to a release position either side of said stop to provide reversible operation.

* * * * *